United States Patent [19]

Lucian et al.

[11] 4,303,107

[45] Dec. 1, 1981

[54] SWITCHING ON DEVICE ON AN APPARATUS FOR INTERMITTENTLY TAKING OFF WEFT YARN

[75] Inventors: Anton Lucian; Rudolf Zwiener, both of Arbon, Switzerland; Siegfried Roehrich, Goetzis, Austria

[73] Assignee: Adolph Saurer Limited, Arbon, Switzerland

[21] Appl. No.: 108,299

[22] Filed: Dec. 28, 1979

[30] Foreign Application Priority Data

Jan. 4, 1979 [CH] Switzerland ..... 65/79

[51] Int. Cl.[3] ..... D03D 47/34

[52] U.S. Cl. ..... 139/450; 139/452

[58] Field of Search ..... 139/116, 429, 450, 452; 226/8, 120; 66/132

[56] References Cited

U.S. PATENT DOCUMENTS

| | | | |
|---|---|---|---|
| 3,561,498 | 2/1971 | Tiernan | 139/116 |
| 4,074,730 | 2/1978 | Mizuno | 139/452 |
| 4,102,362 | 7/1978 | Tojo | 139/452 |

FOREIGN PATENT DOCUMENTS

| | | | |
|---|---|---|---|
| 7301037 | 7/1974 | Netherlands | 139/452 |

*Primary Examiner*—Henry Jaudon

*Attorney, Agent, or Firm*—Bailey, Dority & Flint

[57] ABSTRACT

A device for holding the weft yarn outside of a pair of takeoff rolls after there has been a filling break or upon starting up of the loom. The takeoff rolls in normal operation withdraw a measured length of yarn from a supply package and feed the yarn to a storage device such as a suction tube. The rapier on its filling stroke withdraws the measured length of yarn from the storage tube on each stroke of filling insertion. As the rapier approaches the end of the stroke, the takeoff rolls 4 and 5 separate so that the final portion of the yarn of each filling is taken directly from the supply package. After a filling break or upon starting up of the loom, in order to insure that the length of the first weft yarn is proper, a movable guide arm 14 holds the yarn outside of the takeoff rolls 4 and 5 and the yarn is manually withdrawn from the supply package. At the end of the first stroke of the rapier the rolls 4 and 5 are separated. At this time the pivotal arm automatically brings the yarn between the takeoff rolls and then the takeoff rolls assume their normal operation of feeding a measured length of yarn to the storage device on each subsequent stroke of the rapier.

2 Claims, 3 Drawing Figures

SWITCHING ON DEVICE ON AN APPARATUS FOR INTERMITTENTLY TAKING OFF WEFT YARN

BACKGROUND OF THE INVENTION

The invention relates to a device that is used with a yarn feeding mechanism that feeds an intermittent length of yarn to a storage element such as a suction tube for subsequently being inserted into the shed of a fabric being woven by a rapier on a shuttleless loom. In normal operation, a pair of takeoff rolls withdraw a measured length of yarn from a package and feeds this measured length of yarn to a storage tube for subsequent insertion by the rapier into the shed of the yarn. The length of yarn stored in the storage tube is slightly less than the full length of the yarn needed for each filling. As a result, just before the rapier reaches the end of its stroke, the feed rolls are separated so that the last approximate inch of filling yarn is pulled directly from the package. The separation of the feed roll as the rapier approaches the end of its stroke is under the control of a cam assembly that is operated off of the main shaft of the loom.

SUMMARY OF THE INVENTION

One problem with such filling or weft inserting devices is that upon starting up of the loom or upon the occurrence of a filling break, the amount of yarn stored in the storage tube is not known. Accordingly, the length of the first filling yarn is either too short or too long and such would present problems. In order to eliminate this problem the device constructed in accordance with the present invention withholds the yarn from between the takeoff rolls during the first filling insertion so that the yarn is drawn directly from the package. As the rapier reaches the end of its first stroke, the takeoff rolls are separated and a pivotal guide through which the yarn is being fed automatically inserts the yarn between the separated takeoff rolls so that when the takeoff rolls are brought back together as the rapier has completed its first weft insertion, the takeoff rolls are again driven under the control of the main shaft of the loom to supply a measured length of yarn to the tube storage which is positioned between the takeoff rolls and the rapier.

The storage tube and the mechanism for opening and closing the feed rolls is disclosed in co-pending application Ser. No. 092,721 entitled Method for Withdrawal of Weft Yarn in Shuttleless Looms and Apparatus for Carrying Out the Method, filed in the U.S. Patent Office on Nov. 9, 1979. The primary purpose of the subject invention is to withhold the yarn from between takeoff rolls used for supplying a measured length of yarn to an intermediate storage device on the first weft insertion after there has been a weft break or upon starting up of the loom so that a desired length of yarn will be stored in the storage device on each subsequent cycle.

This is accomplished by means of a movable guide 14 that is positioned adjacent the takeoff rolls through which the yarn passes on its path from the yarn package to the loom. By manipulating a handle the movable guide deflects the path of the yarn from between the takeoff rolls 4 and 5. At the end of the first stroke of the rapier, a tappet which is carried on the top of a pivot lever upon which one of the takeup rolls is carried, engages a spring bar as the takeoff rolls are separated.

The spring bar, in turn, causes the pivotably mounted eve to draw the yarn between the separated takeoff rolls so that on the next stroke of the rapier, the yarn will be positioned between the takeoff rolls which feed a measured length of yarn to the storage device provided between the takeoff rolls and the rapier of the loom.

Accordingly, it is an important object of the present invention to provide a device for shifting the path of yarn outside the normal takeoff path extending between takeoff rollers in order to manually withdraw weft yarn from a supply package and for automatically returning the yarn to its normal path between the takeoff rollers upon commencement of the normal takeoff operation.

DESCRIPTION OF A PREFERRED EMBODIMENT

Figure 1:
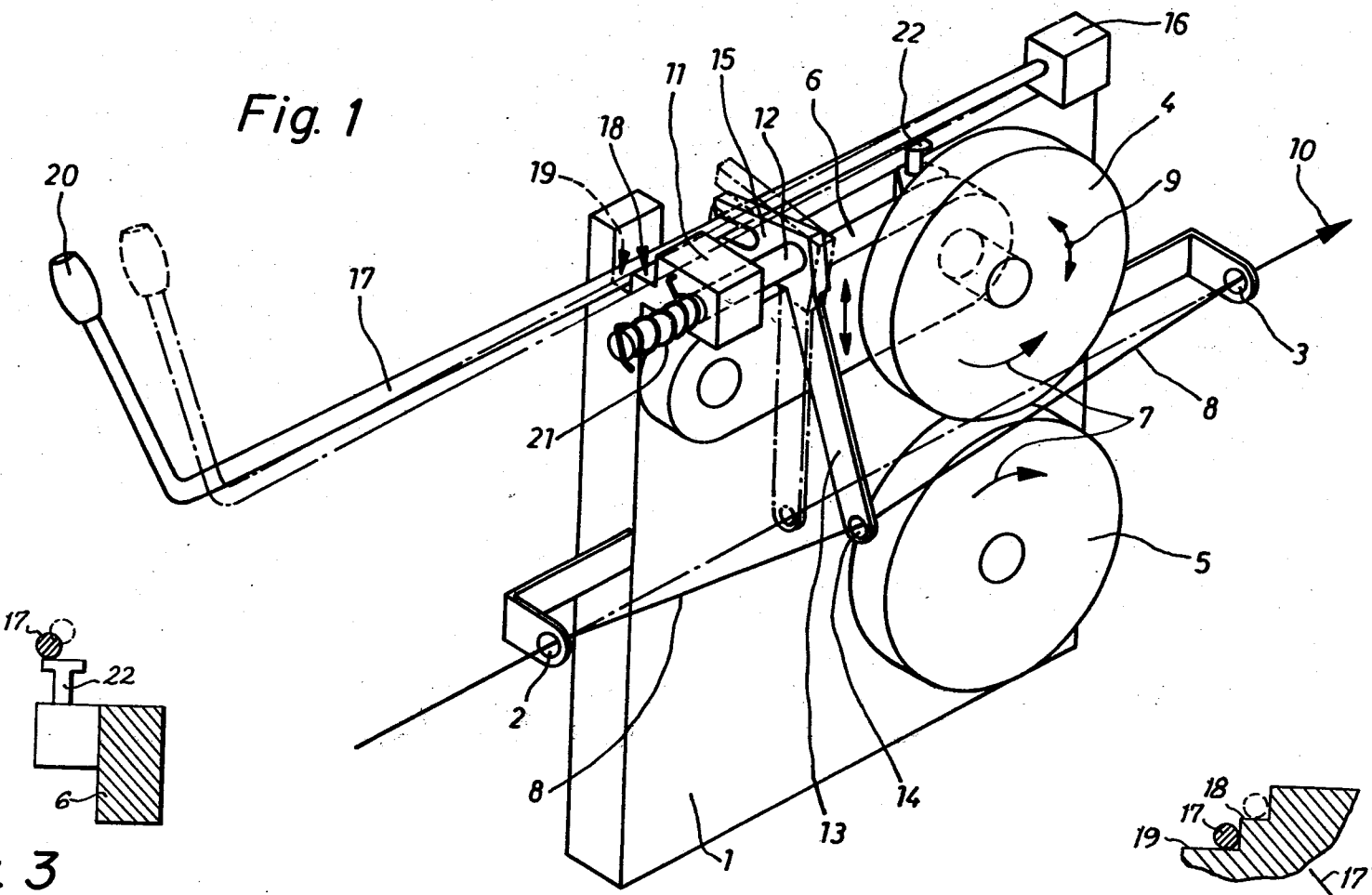
FIG. 1 is a perspective view of a device constructed in accordance with the present invention.

Referring to FIG. 1, there is illustrated a supporting plate 1 for an apparatus for taking off weft yarn from a supply package (not shown) and feeding the weft yarn to a storage tube for subsequent insertion into the shed of fabric being woven by a rapier. The yarn in its normal path, extends through fixed guiding eyes 2 and 3 carried by the support plate 1 with guiding eye 2 being positioned in front of takeoff rollers 4 and 5 and guiding eye 3 being located behind the takeoff rollers. Takeoff roller 4 is rotatably mounted on a pivot lever 6 and driven at a constant speed in the direction of arrow 7 by the main shaft of the loom (not shown). The drive for the takeoff rolls and the manner of pivoting pivot lever 6 for separating takeoff roll 4 from takeoff roll 5 is described more fully in co-pending application Ser. No. 092,721.

The pivot lever 6 carries a tappet 22 and is pivotable according to arrow 9 for separating the rollers 4 and 5 during the weft inserting cycle. Such separation is under the control of a cam drive which, in turn, is controlled by the main shaft of the loom. Accordingly, the takeoff rolls 4 and 5 assume two positions—a takeoff position and a release position. In the takeoff position, the peripheries of the rolls 4 and 5 press on each other and clamp the weft thread lying therebetween. Since the rolls are driven, they withdraw a measured length of yarn from a supply package in the direction of arrow 10 and supply the yarn to an intermediate storage device. In the release position, the pivot lever 6 is raised causing roll 4 to be raised out of contact with roll 5. When the rolls are separated they do not withdraw yarn from the supply package.

On the supporting plate 1 is provided a bearing block or blocking mechanism 11 carrying a pivot pin 12. The pivot pin 12 carries an arm 13 which has a guiding eye 14 positioned adjacent its lower end which during normal takeoff operation lies in line with the eyelets 2 and 3 so that the path of the yarn passes between the takeoff rollers 4 and 5, as shown in broken lines in FIG. 1. A fork lever 15 is integral with the upper end of the arm 13, and as a result the fork lever 15 and arm 13 rotate together.

At the other end of the support plate 1 is mounted a second bearing block 16 for fixing one end of a spring bar 17 positioned above the pivot lever 6. The bar 17 passes through the fork slot of the fork lever 15 and is supported against a stop surface 18 of blocking mechanism 11 during normal operation. A handle 20 is provided on an outer end of the spring bar 20.

In normal operation which is shown in the broken line position in FIG. 1, the spring bar 17 is located slightly above the top of a tappet 22, when the pivot lever 6 is pivoted upward for separating the rollers 4 and 5. A second stop surface 19 of blocking mechanism 11 is positioned below the stop surface 18. The stop surface 19 is positioned so that when the spring bar 17 is positioned thereon, the bar 17 is in contact with the top of the tappet 22 when the rollers are in contact with each other as occurs during takeoff of yarn from the supply package. The pivot pin 12 is under the influence of a torsion spring 21 which exerts an upward directed force upon the spring bar 17. The operation of the spring 21 is incidental to the operation of the overall device and merely supplements the resiliency of the spring bar 17. For purposes of understanding the invention, the spring 21 could be completely eliminated.

Figure 2:
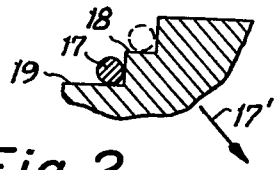
FIG. 2 is a fragmentary sectional view illustrating the two positions assumed by the spring bar 17.
Figure 3:
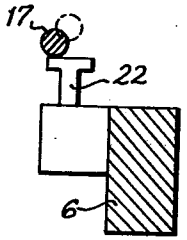
FIG. 3 is an elevational view partially in section, illustrating the manner in which the bar 17 is lifted.

The device operates as follows:

On starting or restarting the weaving process after correcting a fault, the spring bar 17, which in normal operation as a result of its inherent elasticity is supported against stop surface 18 as shown in broken lines in FIGS. 1 and 2. The spring bar 17 is manually moved by gripping the handle 20 against the action of torsion spring into the angle of stop surface 19 from which it is held due to a frictional effect, as shown in full lines in FIGS. 1 and 2. As a result, the fork lever 15 is pressed downwards and the arm 13 is pivoted outward to the full line position whereby the guiding eye 14 deflects the weft yarn 8 from between the takeoff rollers 4 and 5, as shown in full lines in FIG. 1. Before the loom is started up in operation, a certain length of weft thread, approximately the length which should be present in the intermediate store prior to each weft insertion, is withdrawn from the supply package by hand. The loom is then started and the takeoff rollers are driven while in contact with each other, however, since there is no yarn passing between the rollers no additional yarn is fed to the intermediate storage device. The rapier or weft inserter then inserts the yarn that was withdrawn by hand and stored in the storage device during the first pick of operation. During this first pick or first stroke of the rapier, it withdraws the yarn that was previously withdrawn by hand from the storage device until it is used up, then the weft inserter withdraws additional yarn directly from the supply package until the whole length of weft thread is inserted in the shed of the fabric. Towards the end of the first stroke of the weft inserter, the pivot lever 6 is lifted under control of a cam arm and the main shaft of the loom as described in more detail in co-pending application, Ser. No. 092,721. Roll 4 as a result no longer has pressure contact with roll 5. During this lifting movement, the tappet 22 engages the spring bar 17 and lifts it off of stop surface 19. This, in turn, causes the fork lever 15 to move upwards and the arm 13 to be pivoted from the full line position to the broken line position wherein the thread guide 14 brings the yarn 8 back in between the separated rolls 4 and 5. On account of its inherent elasticity, the spring bar 17 strikes against the stop surface 18 and the takeoff process proceeds normally for each stroke of the rapier thereafter. The direction of prestressing of the lever arm 17 is in the direction of the arrow 17' as shown in FIG. 2. As a result, the spring rod remains in either the angle stop 18 or the angle stop 19 until it is either automatically moved or moved manually by manipulating handle 20.

While a preferred embodiment of the invention has been described using specific terms, such description is for illustrative purposes only, and it is to be understood that changes and variations may be made without departing from the spirit or scope of the following claims.

What is claimed is:

1. A device for use on a shuttleless loom for deflecting yarn from between a pair of takeoff rolls during a portion of a first stroke of a weft inserter after startup of said loom so that said yarn can be drawn directly from a supply package and for automatically inserting said yarn between said takeoff rolls when said rolls are separated adjacent the end of said first stroke of said weft inserter so that on subsequent strokes of said weft inserter, measured lengths of yarn are taken off said package by said takeoff rolls and fed to a yarn storage device interposed between said takeoff rolls and said weft inserter;

a movable mounting supporting one of said takeoff rolls that are shifted during each stroke of said weft inserted from a takeoff position wherein said takeoff rolls withdraw yarn from said package to a release position wherein said takeoff rolls are separated, said device comprising;

a movable yarn guide positioned between said package and said takeoff rolls engaging said yarn;

means for shifting said movable guide to a first position deflecting said yarn outside of said takeoff rolls;

a blocking mechanism for holding said movable guide in said first position; and means operably connected to said movable mounting for shifting said movable guide from said first position to a second position when said rolls are separated for inserting said yarn between said takeoff rolls so that said takeoff rolls can withdraw measured lengths of yarn from said package after said first stroke of said weft inserter.

2. The device as set forth forth in claim 1 further comprising:

said means for shifting said movable guide including:

(i) a pivotal arm carrying said movable guide, and (ii) a spring bar which is fixed at one end controlling the position of said movable guide between said first and second positions, and said blocking mechanism including a pair of stop surfaces for holding said spring bar.

* * * * *